US005390921A

United States Patent [19]

De Ruyter

[11] Patent Number: 5,390,921

[45] Date of Patent: Feb. 21, 1995

[54] TUBULAR GOLF SHAFT EXTENDING DEVICES

[76] Inventor: Eugene J. De Ruyter, 7941 Roswell Rd., Suite A, Atlanta, Ga. 30350

[21] Appl. No.: 223,015

[22] Filed: Apr. 5, 1994

[51] Int. Cl.[6] ..... A63B 53/16

[52] U.S. Cl. ..... 273/81.2; 273/81 D

[58] Field of Search ..... 273/80 R, 81 R, 81 A, 273/81 D, 81.2, 165

[56] References Cited

U.S. PATENT DOCUMENTS

| | | | |
|---|---|---|---|
| 1,557,156 | 10/1925 | Gless | 273/81.2 |
| 1,573,612 | 2/1926 | Johnston | 273/165 |
| 1,680,447 | 8/1928 | Bryant | 273/80 R |
| 1,851,439 | 3/1932 | Mattern | 273/81 R |
| 3,539,185 | 11/1970 | Andis | 273/81.2 |
| 4,211,415 | 7/1980 | Lindo | 273/162 B |
| 4,669,726 | 6/1987 | Lempio | 273/81.2 |
| 4,674,747 | 6/1987 | Mazzocco et al. | 273/81.2 |
| 4,746,120 | 5/1988 | Mockovak | 273/81.5 |
| 4,932,661 | 6/1990 | Choi | 273/81.2 X |
| 5,024,438 | 6/1991 | Candow | 273/81 R |

*Primary Examiner*—William H. Grieb

[57] ABSTRACT

A tubular golf shaft extending device comprising a tubular member which is fabricated of steel or graphite and which has an upper open end and a lower open end. The exterior diameter of the member is essentially the same as the exterior diameter of the upper end of a golf club shaft. The length of the member is about 3 ½ inches whereby the majority of the member may be positioned as an extension to extend beyond the upper end of the shaft. Also included is an adhesive which is located between the upper end of the shaft and the lower end of the member to form an adhesive bond therebetween. A grip is positioned over the member and the upper extent of the shaft.

5 Claims, 4 Drawing Sheets

TUBULAR GOLF SHAFT EXTENDING DEVICES

BACKGROUND OF THE INVENTION

1. Field of the Invention

The present invention relates to tubular golf shaft extending devices and more particularly pertains to extending the length of golf club shafts through a tubular addition.

2. Description of the Prior Art

The use of golf club shafts of varying lengths is known in the prior art. More specifically, golf club shafts of varying lengths heretofore devised and utilized for the purpose of extending the lengths of golf clubs to a desired extent are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,539,185 to Andis discloses a golf club having an adjustable length shaft.

U.S. Pat. No. 4,211,415 to Lindo discloses a golf club combined with foldable extensions for surveying greens.

U.S. Pat. No. 4,674,747 to Mezzocco et al discloses a golf club having adjustable length shaft.

U.S. Pat. No. 4,932,661 to Choi discloses an extensible exercise golf club.

Lastly, U.S. Pat. No. 5,024,438 to Candow discloses a detachable golf putter extension.

In this respect, the tubular golf shaft extending devices according to the present invention substantially departs from the conventional concepts and designs of the prior art, and in doing so provides an apparatus primarily developed for the purpose of extending the length of golf club shafts through a tubular addition.

Therefore, it can be appreciated that there exists a continuing need for new and improved tubular golf shaft extending devices which can be used for extending the length of golf club shafts through a tubular addition. In this regard, the present invention substantially fulfills this need.

SUMMARY OF THE INVENTION

In view of the foregoing disadvantages inherent in the known types of golf club shafts of varying lengths now present in the prior art, the present invention provides an improved tubular golf shaft extending devices. As such, the general purpose of the present invention, which will be described subsequently in greater detail, is to provide a new and improved tubular golf shaft extending devices and method which has all the advantages of the prior art and none of the disadvantages.

To attain this, the present invention essentially comprises a tubular golf shaft extending devices comprising a tubular member which is fabricated of steel or graphite and which has an upper open end and a lower open end. The exterior diameter of the member is essentially the same as the exterior diameter of the upper end of a golf club shaft. The length of the member is about 3½ inches whereby the majority of the member may be positioned as an extension to extend beyond the upper end of the shaft. Further included is a circumferential mark on the shaft to indicate the proper positioning of the lower end of the member with respect to the shaft. Further included is an adhesive which is located between the upper end of the shaft and the lower end of the member to form an adhesive bond therebetween. A grip is positioned over or in the member and the upper extent of the shaft.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved tubular golf shaft extending devices which have all the advantages of the prior art golf club shafts of varying lengths and none of the disadvantages.

It is another object of the present invention to provide new and improved tubular golf shaft extending devices which may be easily and efficiently manufactured and marketed.

It is further object of the present invention to provide new and improved tubular golf shaft extending devices which are of durable and reliable constructions.

An even further object of the present invention is to provide new and improved tubular golf shaft extending devices which are susceptible of a low cost of manufacture with regard to both materials and labor, and which accordingly are then susceptible of low prices of sale to the consuming public, thereby making such tubular golf shaft extending devices economically available to the buying public.

Still yet another object of the present invention is to provide new and improved tubular golf shaft extending devices which provide in the apparatuses and methods of the prior art some of the advantages thereof, while simultaneously overcoming some of the disadvantages normally associated therewith.

Even still another object of the present invention is to extend the length of golf club shafts through a tubular addition.

Lastly, it is an object of the present invention to provide new and improved tubular golf shaft extending devices comprising a tubular member which is fabricated of steel or graphite and which has an upper open end and a lower open end. The exterior diameter of the member is essentially the same as the exterior diameter of the upper end of a golf club shaft. The length of the member is about 3½ inches whereby the majority of the member may be positioned as an extension to extend beyond the upper end of the shaft. Also included is an adhesive which is located between the upper end of the shaft and the lower end of the member to form an adhesive bond therebetween. A grip is positioned over the member and the upper extent of the shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
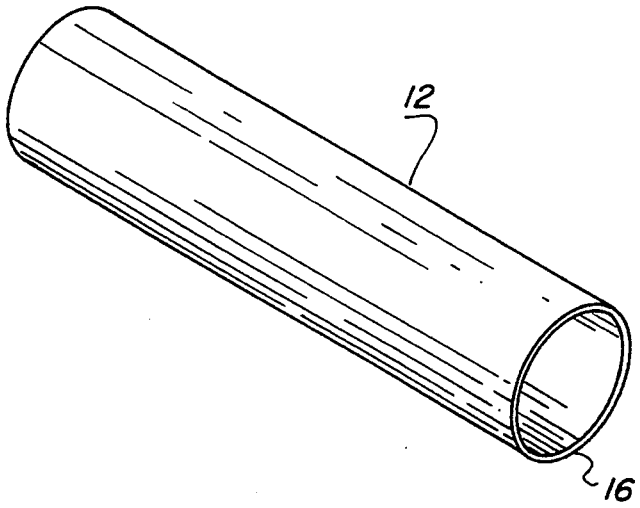
FIG. 1 is a perspective illustration of the preferred embodiment of the tubular golf shaft extending devices constructed in accordance with the principles of the present invention.
Figure 2:
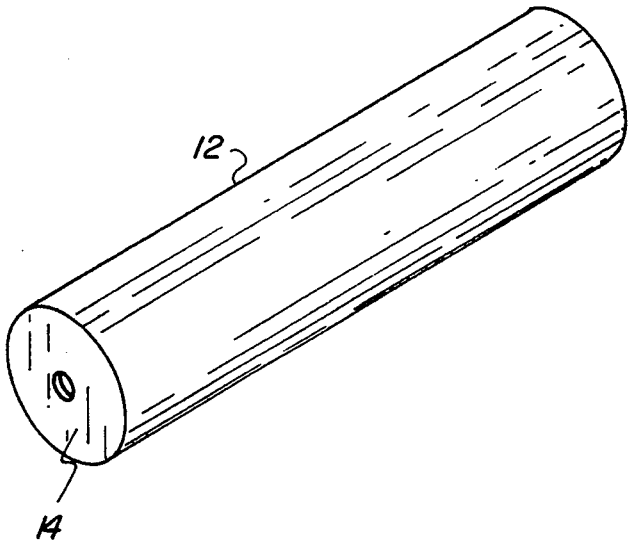
FIG. 2 is a perspective view of the device of FIG. 1 viewed from the opposite end.
Figure 3:
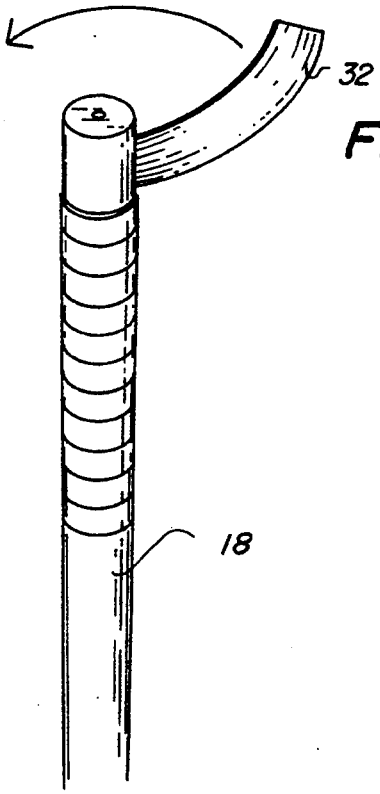
FIG. 3 is a perspective illustration of the existing golf club shaft at the lower end with the grip material being unwound.
Figure 4:
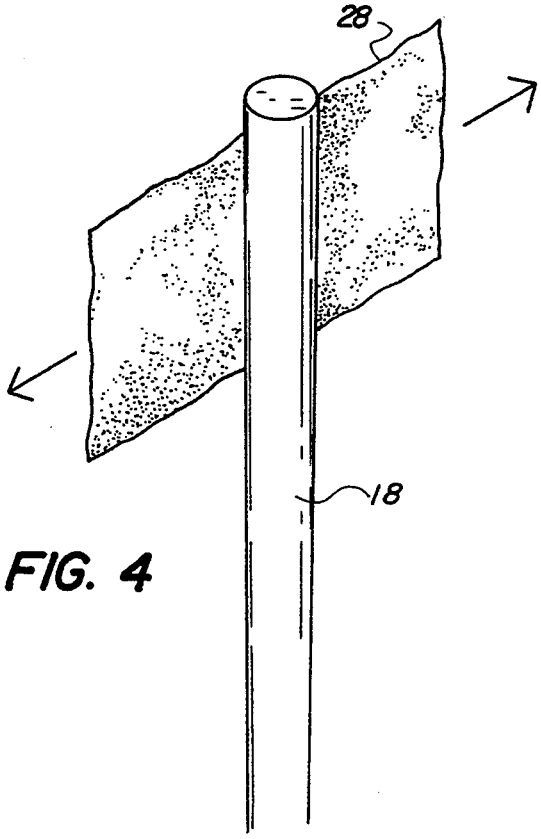
FIG. 4 is a perspective showing of the unwrapped upper extent of the grip being cleaned for the receipt of the device of the present invention.
Figure 6:
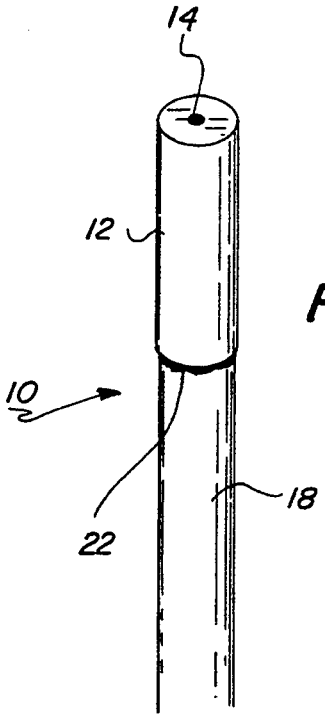
FIG. 6 is a perspective showing of the device of the present invention on the upper end of a golf club shaft with a mark to indicate the proper positioning thereof.
Figure 5:
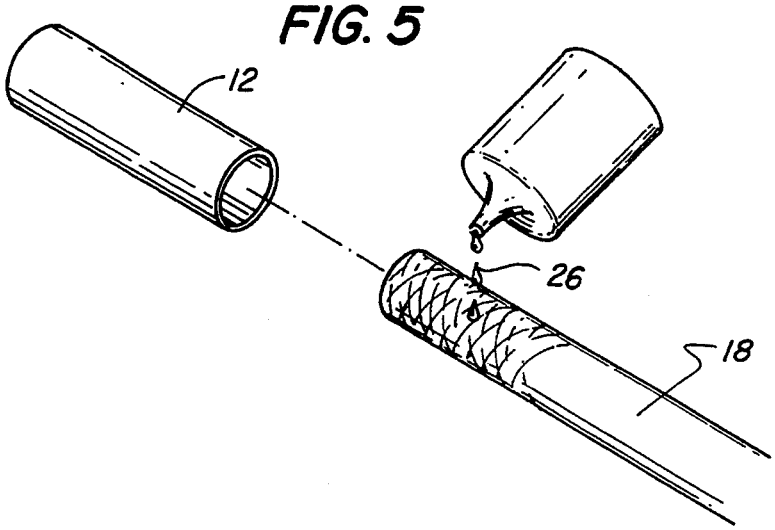
FIG. 5 is a perspective illustration of an adhesive being provided to the upper end of the golf club shaft adapted to receive the device of the present invention.
Figure 7:
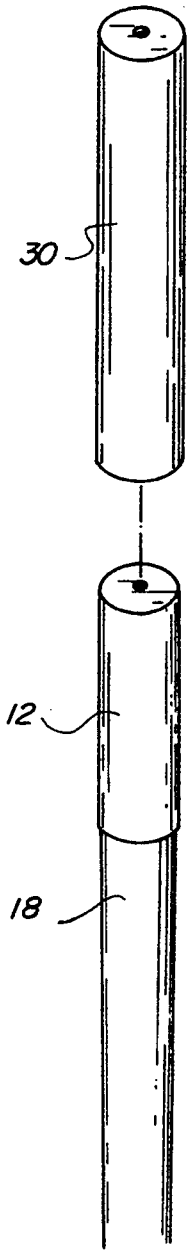
FIG. 7 is a perspective showing of the device of the present invention in place on the upper end of a golf club shaft adapted to receive a replacement grip.
Figure 8:
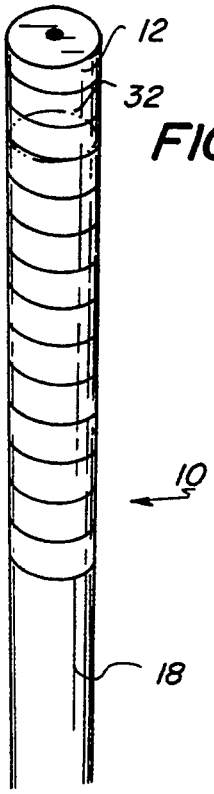
FIG. 8 is a perspective showing of the device with the replacement grip and new tape thereover.
Figure 9:
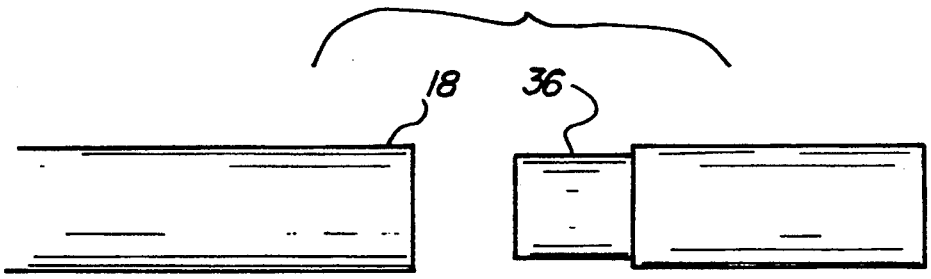
FIG. 9 is a perspective exploded illustration of an alternate embodiment of the invention.
Figure 10:
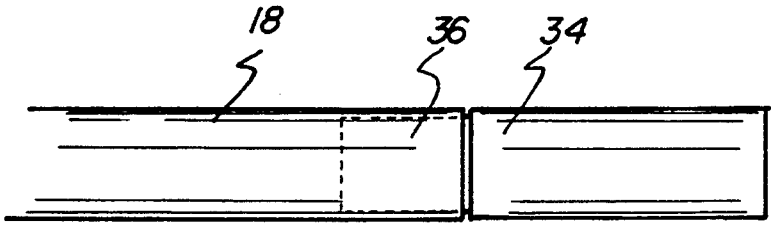
FIG. 10 is a perspective illustration of the FIG. 9 embodiment with the parts coupled.
Figure 11:
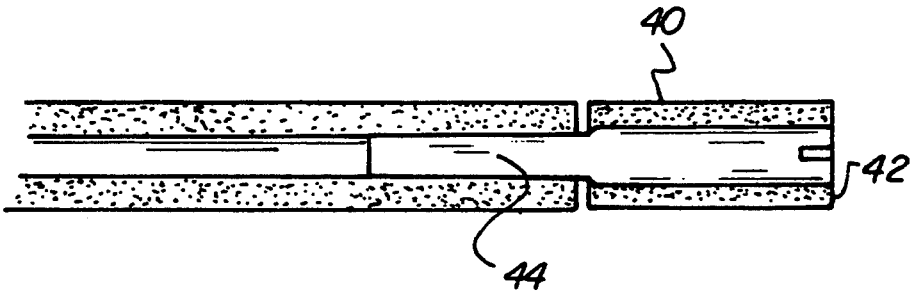
FIG. 11 is a further alternate embodiment of the invention similar to that shown in FIGS. 9 and 10.

With reference now to the drawings, and in particular to FIG. 1 thereof, the preferred embodiment of the new and improved tubular golf shaft extending devices embodying the principles and concepts of the present invention and generally designated by the reference numeral 10 will be described.

The device features a tubular member 12. Such member is preferably fabricated of steel. It has an upper open end 14 and a lower open end 16. The interior diameter of the member is about ½ inch. This is slightly greater than the exterior diameter at the upper end 18 of the golf club shaft.

The length of the tubular member is about 3½ inches. In this manner, the majority of the member may be positioned over or in the upper end of the shaft with a portion of the member extending beyond the upper end of the shaft to provide the shaft, in essence, with an added length.

In the fabrication, a circumferential mark 22 is preferably formed on the shaft to indicate the proper positioning of the shaft. The mark is made prior to the application of any adhesive so as to indicate the proper positioning of the lower end of the tube with respect to the shaft. This is to aid in the placement of the tubular member on the shaft for proper positioning.

Next provided is an adhesive 26. The adhesive is located between the upper end of the shaft 18 and the lower end of the member 12. Prior to applying the glue to the exterior surface at the upper end of the shaft 18, the area to receive the glue 26 and tubular member 12 are provided with score marks as through sandpaper 28 to ensure a greater securement between the areas being glued. With the glue in place, the tubular member is slid into position to the area with its open end 16 adjacent to the circumferential marks 22 as previously determined. After the glue has set for a predetermined amount of time, the tubular member is in place essentially permanently with the length of the shaft increased to the extent desired by the user.

Lastly, a grip 30 or 32 of any conventional design, whether tubular or wrap around, is then positioned over the member and the upper extent of the shaft. The resulting structure is a golf club with a shaft of an extended length without having gone through the problem of buying a new golf club or having it reshafted.

The present invention is a 3½ inch long steel nipple, ½ inch in diameter that can be glued over or inside the end of a golf club shaft to make it longer. It is installed by first removing the old tape or other covering from the end of the shaft, then thoroughly cleaning any residue with a solvent and a clean rag. If the shaft is chrome plated, the first 2 or 2½ inches must be roughened up to get a good glue bond. Once this is done, the present invention is marked for the proper length and a self-curing glue is applied to the prepared surface. The present invention is then slipped over or inside the end of the shaft. Once the glue has set, a new grip is added over the handle and its extension.

In the first alternate embodiment of the invention, the extension member is a tubular member 34. Such member is a 314 12 inch steel shaft extension. The majority, about 2 inches, is of an exterior diameter essentially that of the golf club shaft. The lower end 36 is of a reduced diameter to fit interior of the upper end of the golf club shaft. In this manner, the extension member is simply slid into the upper end of a golf club shaft after having its tape removed and surfaces cleaned. An adhesive 26 is positioned between the tubular extension member and the golf club shaft to render the extension permanent.

The final embodiment is similar to that as described in the immediate paragraph. The only difference is that the extension member 40 is formed of two parts, an upper part 42 of an enlarged diameter essentially equal to that of the exterior surface of the golf club shaft and an interior member 44 of a reduced diameter. The lower or interior member has an exterior surface adapted to fit within the interior surface of the extension at one and, at its lower end, within the interior surface of the golf club shaft.

In this manner a plurality of embodiments are provided for the convenience of the user.

Golf is one of the more popular sports in this country. Recently, golf club manufacturers have been making the shafts of their clubs just a bit longer. This allows golfers to develop a little faster swing and hit the ball harder, thereby obtaining longer drives. However, most golfers have older clubs that are not as long as the new ones and it would be a waste of money and material to replace them. The present invention provides an easy and convenient way to modify old golf clubs by adding an inch or so to their length to make them compatible with the newer and longer clubs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved tubular golf shaft extending device comprising, in combination:

a tubular member fabricated of steel having an upper open end and a lower open end, the interior diameter of the member being about ½ inch, slightly greater than the exterior diameter of the upper end of a golf club shaft, the length of the member being about 3½ inches whereby the majority of the member may be positioned over or in the upper end of a shaft with a portion of the member extending beyond the upper end of the shaft;

a circumferential mark on the shaft to indicate the proper positioning of the lower end of the member with respect to the shaft;

an adhesive located between the upper end of the shaft and the interior lower end of the member to form an adhesive bond therebetween; and a grip positioned over the member and the upper extent of the shaft.

2. A tubular golf shaft extending device comprising:

a tubular member fabricated of steel or graphite having an upper open end and a lower open end, the exterior diameter of the member being essentially the same as the exterior diameter of the upper end of a golf club shaft, the length of the member being about 3½ inches whereby the majority of the member may be positioned as an extension to extend beyond the upper end of the shaft;

an adhesive located between the upper end of the shaft and the lower end of the member to form an adhesive bond therebetween; and a grip positioned over the member and the upper extent of the shaft.

3. The apparatus as set forth in claim 2 wherein the member has a open upper end and an open under end adapted to slide over the exterior upper end of a golf club shaft.

4. The apparatus as set forth in claim 2 wherein the tubular member has an upper end of a diameter essentially equal to that of the upper end of the golf club shaft and an inner end of a reduced diameter to fit within the interior surface at the upper end of a golf club shaft.

5. The apparatus as set forth in claim 4 wherein the tubular device is hollow with an extension member positionable to be located within the interior surface of the device and the interior surface of the golf club shaft.

* * * * *